US011242225B2

(12) United States Patent
Jung et al.

(10) Patent No.: US 11,242,225 B2
(45) Date of Patent: Feb. 8, 2022

(54) ADAPTIVE ELEVATOR DOOR DWELL TIME

(71) Applicant: Otis Elevator Company, Farmington, CT (US)

(72) Inventors: WoonCheol Jung, Seoul (KR); Hansoo Shim, Uiwang-si (KR)

(73) Assignee: OTIS ELEVATOR COMPANY, Farmington, CT (US)

( * ) Notice: Subject to any disclaimer, the term of this patent is extended or adjusted under 35 U.S.C. 154(b) by 824 days.

(21) Appl. No.: 15/922,060

(22) Filed: Mar. 15, 2018

(65) Prior Publication Data

US 2019/0284024 A1 Sep. 19, 2019

(51) Int. Cl.

| | |
|---|---|
| ***B66B 13/14*** | (2006.01) |
| ***B66B 13/22*** | (2006.01) |
| ***B66B 1/28*** | (2006.01) |
| ***B66B 1/34*** | (2006.01) |
| ***B66B 9/00*** | (2006.01) |
| *B66B 13/06* | (2006.01) |

(52) U.S. Cl.
CPC ..... *B66B 13/146* (2013.01); *B66B 1/28* (2013.01); *B66B 1/3476* (2013.01); *B66B 9/00* (2013.01); *B66B 13/06* (2013.01)

(58) Field of Classification Search
USPC ..... 187/247
See application file for complete search history.

(56) References Cited

U.S. PATENT DOCUMENTS

| | | | |
|---|---|---|---|
| 4,691,808 | A | 9/1987 | Nowak et al. |
| 5,192,836 | A | 3/1993 | Schroder |
| 5,235,143 | A | 8/1993 | Bahjat et al. |
| 5,239,141 | A | 8/1993 | Tobita et al. |
| 5,286,930 | A | 2/1994 | Bittar et al. |
| 5,503,249 | A | 4/1996 | Mrtamo et al. |
| 6,237,721 | B1 | 5/2001 | Siikonen |
| 7,992,687 | B2 | 8/2011 | Yumura et al. |
| 9,045,314 | B2 | 6/2015 | Finschi |
| 2012/0043165 | A1 | 2/2012 | Abad |
| 2018/0265333 | A1 * | 9/2018 | Schuster ..... B66B 13/26 |

FOREIGN PATENT DOCUMENTS

| | | | |
|---|---|---|---|
| CA | 2974232 | A1 | 9/2016 |
| CN | 102897637 | A | 1/2013 |
| EP | 0452130 | A2 | 10/1991 |
| JP | H05201668 | A | 8/1993 |
| JP | H0664876 | A | 3/1994 |
| JP | H0940334 | A | 3/1994 |
| JP | 2000211833 | A | 8/2000 |
| JP | 2002220177 | A | 8/2002 |
| JP | 2015048174 | A | 3/2015 |

OTHER PUBLICATIONS

European Search Report for application EP 19162559.9, dated Aug. 12, 2019, 51 pages.

* cited by examiner

*Primary Examiner* — Christopher Uhlir
(74) *Attorney, Agent, or Firm* — Cantor Colburn LLP

(57) ABSTRACT

A method of controlling an elevator door dwell time includes obtaining a predefined load weight value; obtaining a load weight value from a load weight sensor coupled to an elevator car; comparing the load weight value to the predefined load weight value to generate a difference; and adjusting the elevator door dwell time in response to the difference to define an adjusted elevator door dwell time.

14 Claims, 4 Drawing Sheets

ADAPTIVE ELEVATOR DOOR DWELL TIME

BACKGROUND

The embodiments disclosed herein relate to elevator systems, and more particularly, to elevator systems having an adaptive elevator door dwell time.

Existing elevator systems employ a door dwell time to control how long the elevator doors remain open when loading or unloading passengers. The door dwell time is a portion of the service time (total travel time from origin to destination) and has an influence on the quality of the elevator service. Conventional elevator systems use a fixed elevator door dwell time when a door open limit (DOL) signal from an elevator door controller is detected. If the elevator system is designed to accommodate handicapped passengers, the elevator door dwell time may always default to a long elevator door dwell time to accommodate handicap passengers. This may result in other passengers having an unnecessary waiting time. Also when passengers press the door open button, the elevator door dwell time may be longer than needed.

BRIEF SUMMARY

According to an embodiment, a method of controlling an elevator door dwell time includes obtaining a predefined load weight value; obtaining a load weight value from a load weight sensor coupled to an elevator car; comparing the load weight value to the predefined load weight value to generate a difference; and adjusting the elevator door dwell time in response to the difference to define an adjusted elevator door dwell time.

In addition to one or more of the features described herein, or as an alternative, further embodiments may include a method wherein the adjusting comprises decreasing the elevator door dwell time when the load weight value is less than the predefined load weight value.

In addition to one or more of the features described herein, or as an alternative, further embodiments may include a method wherein the adjusting comprises increasing the elevator door dwell time when the load weight value is greater than the predefined load weight value.

In addition to one or more of the features described herein, or as an alternative, further embodiments may include a method wherein the adjusting comprises adjusting the elevator door dwell time by at least one of a fixed amount, a fixed percentage and a function of the difference.

In addition to one or more of the features described herein, or as an alternative, further embodiments may include a method wherein the difference is determined by subtracting the load weight value from the predefined load weight value.

In addition to one or more of the features described herein, or as an alternative, further embodiments may include a method including opening the elevator door and, upon expiration of the adjusted elevator door dwell time, closing the elevator door.

In addition to one or more of the features described herein, or as an alternative, further embodiments may include a method wherein the adjusted elevator door dwell time is initiated before the elevator door is fully open.

According to another embodiment, an elevator system includes an elevator car having an elevator car door; a load weight sensor coupled to the elevator car; a controller, the controller configured to execute operations comprising: obtaining a predefined load weight value; obtaining a load weight value from the load weight sensor; comparing the load weight value to the predefined load weight value to generate a difference; and adjusting the elevator door dwell time in response to the difference to define an adjusted elevator door dwell time.

In addition to one or more of the features described herein, or as an alternative, further embodiments may include a system wherein the adjusting comprises decreasing the elevator door dwell time when the load weight value is less than the predefined load weight value.

In addition to one or more of the features described herein, or as an alternative, further embodiments may include a system wherein the adjusting comprises increasing the elevator door dwell time when the load weight value is greater than the predefined load weight value.

In addition to one or more of the features described herein, or as an alternative, further embodiments may include a system wherein the adjusting the elevator door dwell time comprises adjusting elevator door dwell time by a fixed amount, a fixed percentage or a function of the difference.

In addition to one or more of the features described herein, or as an alternative, further embodiments may include a system wherein the difference is determined by subtracting the load weight value from the predefined load weight value.

In addition to one or more of the features described herein, or as an alternative, further embodiments may include a system wherein the controller is configured to open the elevator door and, upon expiration of the adjusted elevator door dwell time, close the elevator door.

In addition to one or more of the features described herein, or as an alternative, further embodiments may include a system wherein the adjusted elevator door dwell time is initiated before the elevator door is fully open.

In addition to one or more of the features described herein, or as an alternative, further embodiments may include a system wherein the controller includes an elevator door controller and an elevator main controller.

According to another embodiment, a computer program product for controlling an elevator door dwell time, the computer program product comprising a non-transitory computer readable storage medium having program instructions embodied therewith, the program instructions executable by a processor to cause the processor to implement operations including: obtaining a predefined load weight value; obtaining a load weight value from a load weight sensor coupled to an elevator car; comparing the load weight value to the predefined load weight value to generate a difference; and adjusting the elevator door dwell time in response to the difference to define an adjusted elevator door dwell time.

Technical effects of embodiments of the present disclosure include adaptively controlling an elevator door dwell time of an elevator system in response to an elevator car load weight value.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
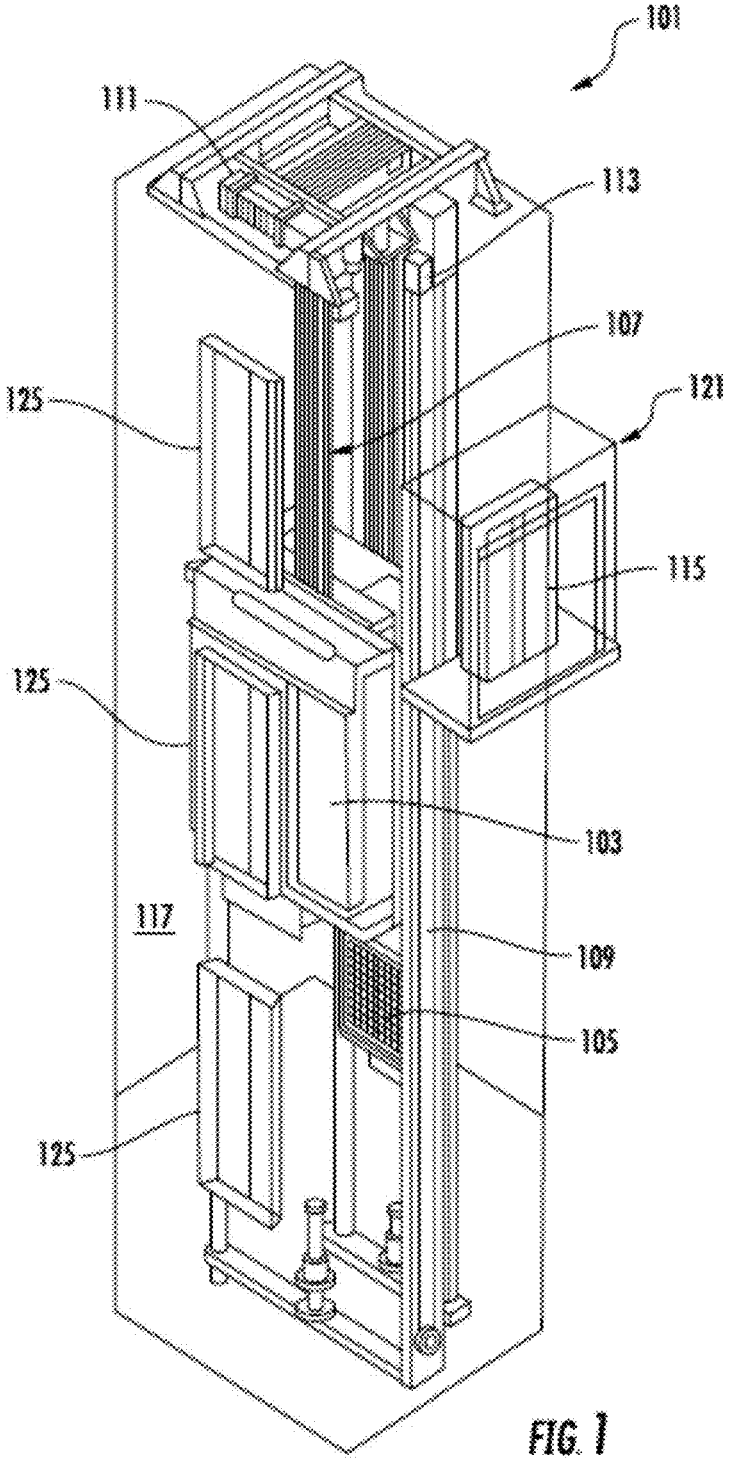
FIG. 1 depicts an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement of the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
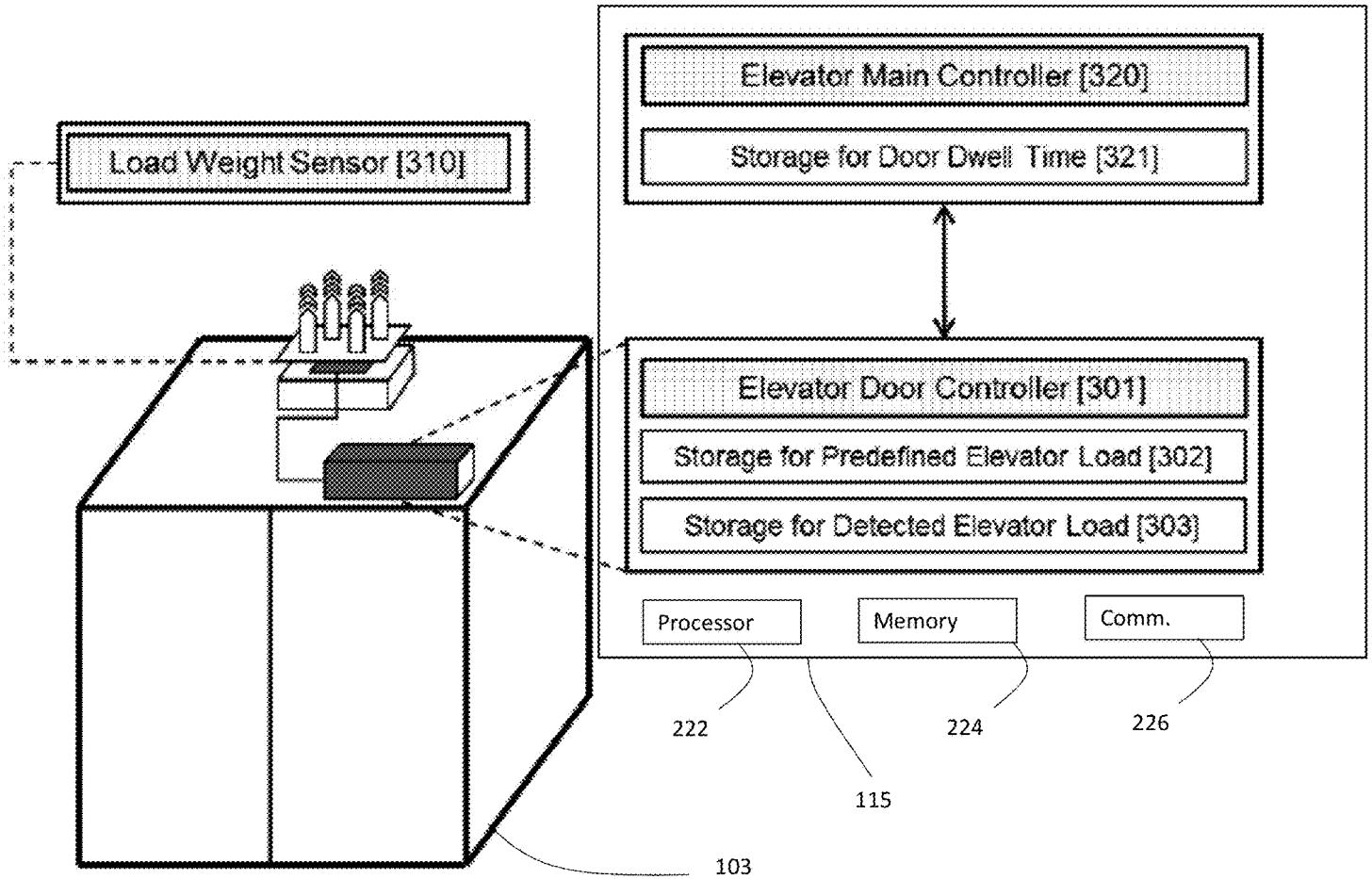
FIG. 2 depicts an elevator car and elevator controller in an example embodiment.

FIG. 2 depicts an elevator car 103 and controller 115 in an example embodiment. The elevator controller 115 may include a processor 222, a memory 224, and communication module 226 as shown in FIG. 2. The processor 222 can be any type or combination of computer processors, such as a microprocessor, microcontroller, digital signal processor, application specific integrated circuit, programmable logic device, and/or field programmable gate array. The memory 224 is an example of a non-transitory computer readable storage medium tangibly embodied in the controller 115 including executable instructions stored therein, for instance, as firmware. The communication module 226 may implement one or more communication protocols to communicate with other system elements, such as a load weight sensor 310. The communication module 226 may communicate over a wireless network, such as 802.11x (WiFi), short-range radio (Bluetooth), or any other known type of wireless communication. The communication module 226 may communicate over wired networks such as LAN, WAN, Internet, etc.

The controller 115 may be implemented using an elevator main controller 320 and an elevator door controller 301. In other embodiments, the controller 115 is a single controller. The elevator door controller 301 and elevator main control 320 main include a processor, memory and communication module as described herein. The elevator door controller 301 may include storage for a predefined elevator load weight value 302 and storage for a detected elevator load weight value 303. The elevator main controller 320 may include storage for a door dwell time 321. In embodiments with a single controller, the storage for a predefined load weight value 302, storage for a detected load weight value 303 and storage for a door dwell time 321 are accessed by the single controller.

The elevator car 103 includes a load weight sensor 310. The load weight sensor may be implemented using known devices for measuring elevator load weight. For example, existing load weight sensors are installed in the floor of the elevator car to measure weight of passengers and cargo in the elevator car 310. Other types of load weight sensors 310 may be used in example embodiments. The load weight sensor 310 provides a detected load weight signal to controller 115 which is saved as the detected load weight value in the storage 303. The controller 115 then adjusts the elevator door dwell time in response to the detected load weight value.

Figure 3:
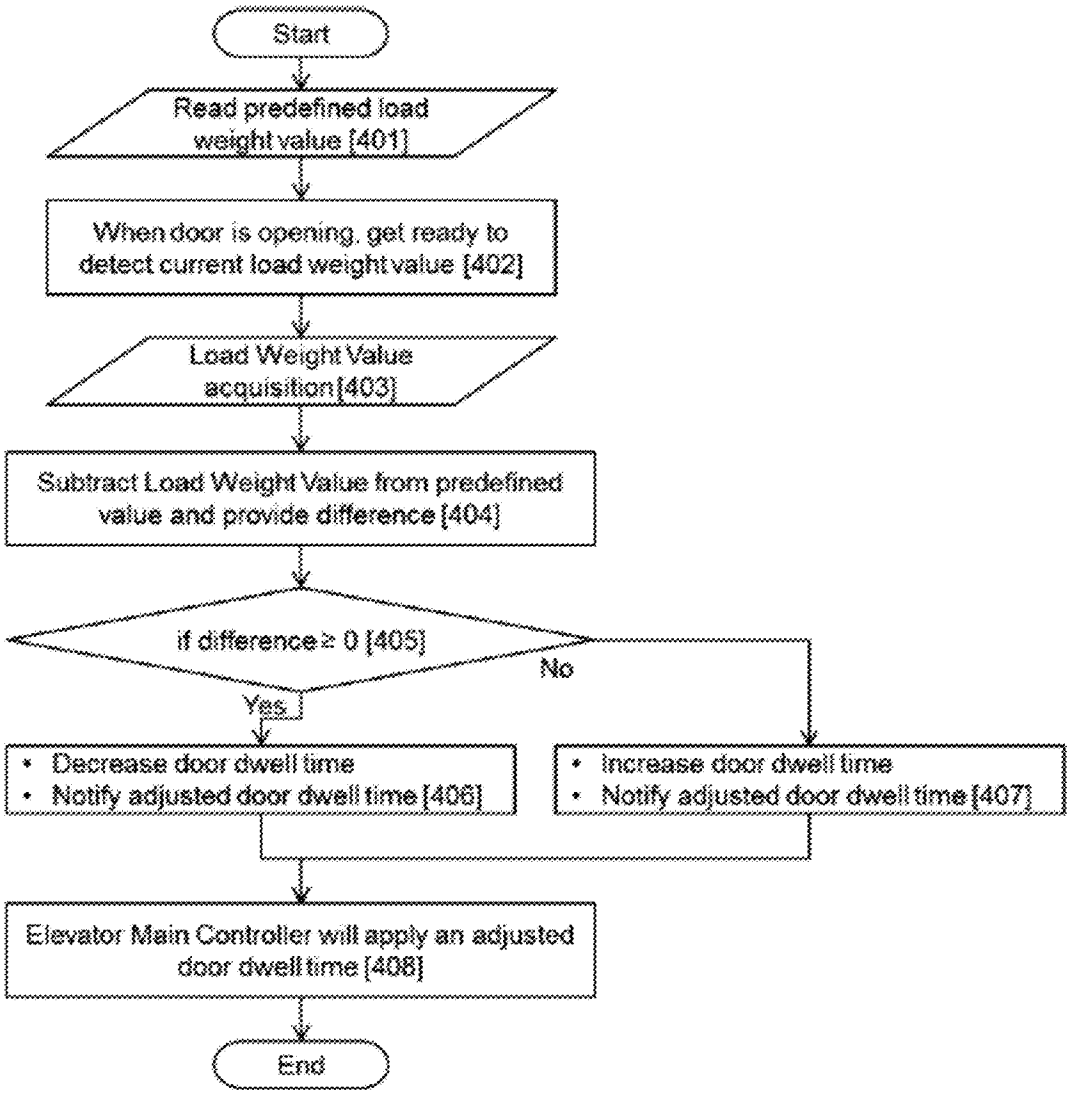
FIG. 3 depicts a flowchart of a process for controlling elevator door dwell time in an example embodiment.

FIG. 3 depicts a flowchart of a process for controlling elevator door dwell time in an example embodiment. The elevator door dwell time is a period of time the door remains open in response to a door open command. The process may be executed by controller 115, which may be a standalone controller or may include the elevator door controller 301 and the elevator main controller 320. The process of FIG. 3 may be executed each time a door open process is initiated.

Reference is made to a single door, but embodiments apply to elevator doors having two panels that meet, two collapsing panels, etc.

The process begins at 401 where a predefined load weight value is obtained. The predefined load weight value serves as a reference to which measure load weight values are compared to adjust the door dwell time. The predefined load weight value may be based on observed conditions over operation of the elevator system. The predefined load weight value may be stored in the storage for predefined elevator load 302.

At 402, when a door is opening, the system prepares to detect a current load weight value. This may include establishing communication between the controller 115 and the load weight sensor 310 via handshaking, etc. At 403, the load weight value (e.g., the current load weight) is obtained by the controller 115 from the load weight sensor 310. The load weight value may be stored in the storage for detected elevator load 303.

At 404, the load weight value is compared to the predefined load weight value. The load weight value may be subtracted from the predefined load weight value to generate a difference. At 405, the difference is compared to an adjustable value, for example, zero. If the difference is greater than or equal to zero, then flow proceeds to 406 where the elevator door dwell time is decreased. In other words, when the load weight value is less than the predefined load weight value, the door dwell time may be decreased. The elevator door dwell time may be decreased by a fixed amount (e.g., 1 second) or a percentage of the current elevator door dwell time (e.g., 10 percent). In other embodiments, the elevator door dwell time is decreased by an amount determined by a function of the difference determined in block 405. For example, the elevator door dwell time may be decreased by the difference (e.g., in kg) multiplied by a correction factor (e.g., in seconds/kg). For example, a 100 kg difference may result in a 2 second decrease in the door dwell time.

If at 405 the difference is less than the adjustable value, then flow proceeds to 407 where the elevator door dwell time is increased. In other words, when the load weight value is greater than the predefined load weight value, the door dwell time may be increased. The elevator door dwell time may be increased by a fixed amount (e.g., 1 second) or a percentage of the current elevator door dwell time (e.g., 10 percent). In other embodiments, the elevator door dwell time is increased by an amount determined by a function of the difference determined in block 405. For example, the elevator door dwell time may be increased by the difference (e.g., in kg) multiplied by a correction factor (e.g., in seconds/kg). For example, a 100 kg difference may result in a 2 second increase in the door dwell time.

At 408, the adjusted elevator door dwell time from either block 406 and 407 is stored in controller 115, for example in storage for door dwell time 321. When the elevator door is opened, the adjusted elevator door dwell time is used to control how long the door remains in the open position. Once the adjusted elevator door dwell time expires, the controller initiates closing the elevator door. The process of FIG. 3 may be executed for each door opening cycle so that the adjusted elevator door dwell time is updated regularly.

Figure 4:
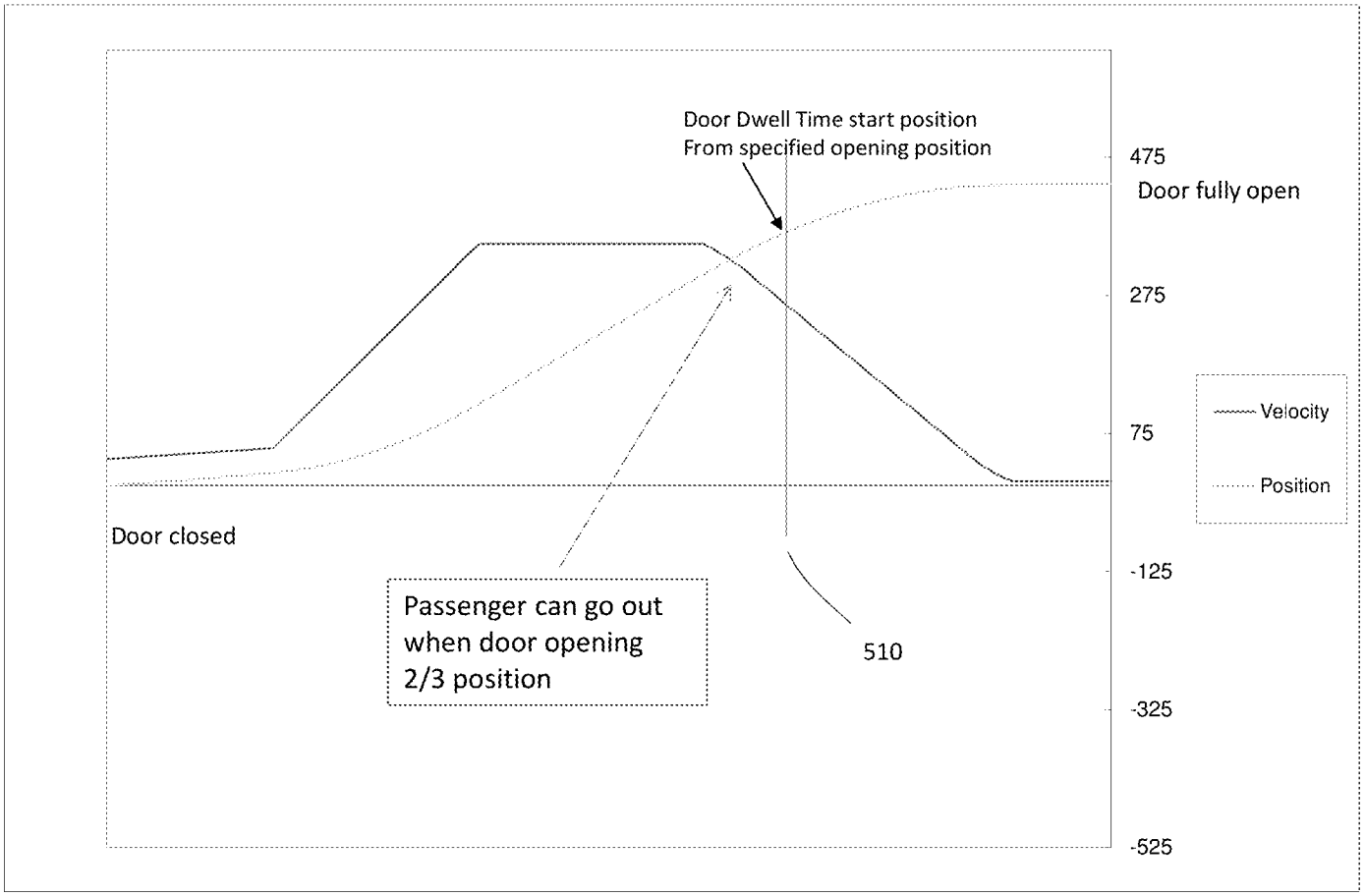
FIG. 4 depicts initiating the elevator door dwell time in an example embodiment.

FIG. 4 depicts initiating the elevator door dwell time in an example embodiment. FIG. 4 depicts position and velocity of the elevator door when going from closed to open. In conventional systems, the door dwell time is not initiated until the door is fully opened. In example embodiments, the door dwell time is initiated when the door is between a fully closed position and the fully open position, shown at location 510 in FIG. 4. Passengers often load and unload when the elevator doors are partially open (e.g., ⅔ open). Starting the elevator door dwell time when the doors are partially open, as shown in FIG. 4, will reduce the wait time for the elevator doors to close. This reduces service time for passengers.

Embodiments adjust elevator door dwell time based on a sensed load weight value of an elevator car. One advantage is that a handicapped passenger or group of passengers would have enough time to enter an elevator, while a single passenger would have increased elevator service experience due to less door dwell time. The door dwell may be calculated just before the door is opened or closed, which continues the door opening/closing motion without hesitating. No additional input device is required from the passengers to adjust the door dwell time and the passengers need not press the door open button. This results in a more accurate service time allocation for each passenger or passenger group.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method of controlling an elevator door dwell time, the method comprising:

obtaining a predefined load weight value;

obtaining a load weight value from a load weight sensor coupled to an elevator car;

comparing the load weight value to the predefined load weight value to generate a difference; and adjusting the elevator door dwell time solely in response to the difference to define an adjusted elevator door dwell time;

wherein the adjusting comprises decreasing the elevator door dwell time when the load weight value is less than the predefined load weight value;

wherein the elevator door dwell time is preset as a period of time an elevator door remains open in response to a door open command.

2. The method of claim 1 wherein the adjusting comprises increasing the elevator door dwell time when the load weight value is greater than the predefined load weight value.

3. The method of claim 1 wherein the adjusting comprises adjusting the elevator door dwell time by at least one of a fixed amount, a fixed percentage and a function of the difference.

4. The method of claim 1 wherein the difference is determined by subtracting the load weight value from the predefined load weight value.

5. The method of claim 1 further comprising opening the elevator door and, upon expiration of the adjusted elevator door dwell time, closing the elevator door.

6. The method of claim 5, wherein the adjusted elevator door dwell time is initiated before the elevator door is fully open.

7. An elevator system comprising:

an elevator car having an elevator car door;

a load weight sensor coupled to the elevator car;

a controller, the controller configured to execute operations comprising:

obtaining a predefined load weight value;

obtaining a load weight value from the load weight sensor;

comparing the load weight value to the predefined load weight value to generate a difference; and adjusting the elevator door dwell time solely in response to the difference to define an adjusted elevator door dwell time;

wherein the adjusting comprises decreasing the elevator door dwell time when the load weight value is less than the predefined load weight value;

wherein the elevator door dwell time is preset as a period of time an elevator door remains open in response to a door open command.

8. The elevator system of claim 7 wherein the adjusting comprises increasing the elevator door dwell time when the load weight value is greater than the predefined load weight value.

9. The elevator system of claim 7 wherein the adjusting the elevator door dwell time comprises adjusting elevator door dwell time by a fixed amount, a fixed percentage or a function of the difference.

10. The elevator system of claim 7 wherein the difference is determined by subtracting the load weight value from the predefined load weight value.

11. The elevator system of claim 8 wherein the controller is configured to open the elevator door and, upon expiration of the adjusted elevator door dwell time, close the elevator door.

12. The elevator system of claim 11, wherein the adjusted elevator door dwell time is initiated before the elevator door is fully open.

13. The elevator system of claim 7 wherein the controller includes an elevator door controller and an elevator main controller.

14. A computer program product for controlling an elevator door dwell time, the computer program product comprising a non-transitory computer readable storage medium having program instructions embodied therewith, the program instructions executable by a processor to cause the processor to implement operations comprising:

obtaining a predefined load weight value;

obtaining a load weight value from a load weight sensor coupled to an elevator car;

comparing the load weight value to the predefined load weight value to generate a difference; and adjusting the elevator door dwell time solely in response to the difference to define an adjusted elevator door dwell time;

wherein the adjusting comprises decreasing the elevator door dwell time when the load weight value is less than the predefined load weight value;

wherein the elevator door dwell time is preset as a period of time an elevator door remains open in response to a door open command.

* * * * *